US011391112B2

(12) United States Patent
Dietrich et al.

(10) Patent No.: US 11,391,112 B2
(45) Date of Patent: Jul. 19, 2022

(54) RISER ADAPTER QUICK CONNECTION ASSEMBLY

(71) Applicant: NTDrill Holdings, LLC, Houston, TX (US)

(72) Inventors: Earl Dietrich, Fulshear, TX (US); Christian Leuchtenberg, Shamrock Park (SG); Glen Cuiper, Haddon Township, NJ (US)

(73) Assignee: NTDrill Holdings, LLC, Houston, TX (US)

( * ) Notice: Subject to any disclaimer, the term of this patent is extended or adjusted under 35 U.S.C. 154(b) by 0 days.

(21) Appl. No.: 17/131,205

(22) Filed: Dec. 22, 2020

(65) Prior Publication Data

US 2021/0189828 A1 Jun. 24, 2021

Related U.S. Application Data

(60) Provisional application No. 62/953,078, filed on Dec. 23, 2019.

(30) Foreign Application Priority Data

Mar. 23, 2020 (GB) ..... 2004166

(51) Int. Cl.
*E21B 33/08* (2006.01)
*E21B 33/038* (2006.01)
*E21B 33/06* (2006.01)

(52) U.S. Cl.
CPC ..... *E21B 33/085* (2013.01); *E21B 33/038* (2013.01); *E21B 33/06* (2013.01)

(58) Field of Classification Search
CPC ..... E21B 17/085; E21B 33/038; E21B 33/06; E21B 33/085
See application file for complete search history.

(56) References Cited

U.S. PATENT DOCUMENTS

2008/0175672 A1* 7/2008 Fraser ..... E21B 17/085 405/170
2011/0266006 A1 11/2011 Lacheny
(Continued)

FOREIGN PATENT DOCUMENTS

CN 104047551 B 2/2017
EP 1947290 B1 4/2011
(Continued)

OTHER PUBLICATIONS

GB Intellectual Property Office, Search Report for corresponding application No. GB2004166.1, Search Report for corresponding application No. GB2004166.1, dated Sep. 23, 2020, GB.
(Continued)

*Primary Examiner* — James G Sayre
(74) *Attorney, Agent, or Firm* — K&L Gates LLP

(57) ABSTRACT

A Jack-up drilling rig or land drilling rig riser system with quick connectors that can be used to rapidly install and de-install RCD housings between the BOP and the drill floor. The quick connector design can handle different bore diameters without changing the external design of the connector. The connector assembly may be used to connect a blowout preventer or rotating control device housing to a tubular riser, a blowout preventer housing to an RCD housing, or to join two tubular risers. A connector assembly connects a tubular pin end to a housing has a tubular connector body with a first end to receive the pin end and a second end secured to the housing. The connector assembly also includes a latching mechanism movable between a lock position to prevent the pin end from being removed and an unlock position in which the pin end can be removed.

11 Claims, 11 Drawing Sheets

(56) References Cited

U.S. PATENT DOCUMENTS

| | | | | |
|---|---|---|---|---|
| 2012/0085545 | A1* | 4/2012 | Tarique | E21B 33/085 166/360 |
| 2014/0216721 | A1* | 8/2014 | DeWesee, Jr. | E21B 23/00 166/117.5 |
| 2018/0051523 | A1* | 2/2018 | Maher | E21B 17/085 |
| 2018/0100369 | A1 | 4/2018 | Perkins | |

FOREIGN PATENT DOCUMENTS

| | | | |
|---|---|---|---|
| WO | 2015080727 | A1 | 6/2015 |
| WO | 2017152190 | A1 | 9/2017 |
| WO | 2019213145 | A1 | 11/2019 |

OTHER PUBLICATIONS

Search Report under Section 17 issued in related GB patent application No. GB2020481.4 dated Jul. 29, 2021 (1 page).

* cited by examiner

RISER ADAPTER QUICK CONNECTION ASSEMBLY

FIELD OF INVENTION

This invention relates in general to fluid drilling equipment and in particular to a rotating control device (RCD) to be used for drilling operations. More specifically, embodiments of the present disclosure relate to an RCD housing that can be inserted into the riser located between the blow out preventer (BOP) and the drill floor of a jack-up drilling rig or a large land drilling rig.

BACKGROUND OF INVENTION

In drilling a well, a drilling tool or "drill bit" is rotated under an axial load within a borehole. The drill bit is attached to the bottom of a string of threadably connected tubulars or "drill pipe" located in the borehole. The drill pipe is rotated at the surface of the well by an applied torque, which is transferred by the drill pipe to the drill bit. As the borehole is drilled, the hole bored by the drill bit is substantially greater than the diameter of the drill pipe. To assist in lubricating the drill bit, drilling fluid or gas is pumped down the drill pipe. The fluid jets out of the drill bit, flowing back up to the surface through the annulus between the wall of the borehole and the drill pipe.

Conventional oilfield drilling typically uses hydrostatic pressure generated by the density of the drilling fluid or mud in the wellbore in addition to the pressure developed by pumping of the fluid to the borehole. However, some fluid reservoirs are considered economically undrillable with these conventional techniques. New and improved techniques, such as underbalanced drilling and managed pressure drilling, have been used successfully throughout the world. Managed pressure drilling is an adaptive drilling process used to more precisely control the annular pressure profile throughout the wellbore. The annular pressure profile is controlled in such a way that the well is either balanced at all times, or nearly balanced with low change in pressure. Underbalanced drilling is drilling with the hydrostatic head of the drilling fluid intentionally designed to be lower than the pressure of the formations being drilled. The hydrostatic head of the fluid may naturally be less than the formation pressure, or it can be induced.

Rotating control devices provide a means of sealing off the annulus around the drill pipe as the drill pipe rotates and translates axially down the well while including a side outlet through which the return drilling fluid is diverted. Such rotating control devices may also be referred to as rotating blow out preventers, rotating diverters or drilling heads. These units generally comprise a stationary housing or bowl including a side outlet for connection to a fluid return line and an inlet flange for locating the unit on a blowout preventer or other drilling stack at the surface of the well bore. Within the bowl, opposite the inlet flange, is arranged a rotatable assembly such as anti-friction bearings which allow the drill pipe, located through the head, to rotate and slide. The assembly includes a seal onto the drill pipe, which is typically made from rubber, polyurethane or another suitable elastomer.

For offshore application on jack-up drilling rigs or floating drilling rigs, the rotating control device may be in the form of a bearing assembly that is latched inside the drilling fluid return riser. The bearing assembly supports a sealing element (such as an RCD mandrel and stripping sleeve) which can seal around a tubular extending through the rotating control device, the bearing assembly being configured so that the sealing element can rotate with the tubular as it rotates about its longitudinal axis. In this case, the side outlet may be on a separate spool or outlet on the riser. Specifically, for jack-up drilling rigs or land drilling rigs the RCD body or housing is typically installed just above the annular BOP situated on top of the main BOP, so that the bearing assembly can be latched inside the RCD housing rather than in the drilling fluid return riser. This involves removing the riser that is bolted to the top of the annular BOP, installing the RCD housing by bolting the bottom flange of this housing to the annular BOP and then re-installing the riser pipe on top of the RCD housing by bolting to the top flange of the RCD housing. As the riser pipe now is too long by the length of RCD housing attached, it usually requires a custom riser pipe to be built before this RCD installation or to cut the existing riser pipe to shorten it, and rewelding it. Later after removing the RCD housing this shortened riser pipe will need to be reinstated to the origin length or a new riser pipe built to the same dimensions as the original one.

The riser has large diameter API flanges typically rated to 5000 or 10,000 psi by 18¾ inches bore on top of the annular BOP and or 21¼ inches bore by 2000 or 3000 psi for some of the riser flanges. Other variations of pressure and bore are possible, the point being that these large diameter flanges are time consuming to break and make up, usually in the range of several hours. Furthermore, they involve personnel working under hazardous conditions above the ocean or production platform at some height just standing on scaffolding. As these types of large diameter API flanges typically require hammer spanners to make up to required torques, this is not an easy working environment.

SUMMARY OF INVENTION

A Jack-up drilling or land drilling rig riser system with a quick connector that can be used to rapidly install and de-install RCD housings between the BOP and the drill floor and enables this type of installation to be done without hammering and the minimum of time and therefore personnel exposure to hazardous conditions. Such a system as disclosed in the invention will also have the required riser spacer spools to enable a configuration with the RCD housing or without the RCD housing to be achieved without requiring any welding or cutting operations. It uses independent latches working on a common external diameter and latch profile diameter to enable the same system to be used for variations in bore and pressure ratings.

One advantage of the system described is the utilization of common part architecture to enable the same quick connector latch design to accommodate variations in the bore and pressure rating in the range of 18¾ inches to 21¼ inches and 2000 psi to 10,000 psi without changing the latch design resulting in cost effective manufacturing.

The advantageous design may enable the installation or de-installation of RCD housing to be done in a fraction of the time required with the current state of the art. The current state of the art involves bolting and unbolting large diameter API flanges (18¾ and 20¾) which can take several hours per flange. The quick connection system may take less than an hour to connect or disconnect, typically tens of minutes. This is a major safety advantage as this is a difficult working area involving scaffolding over open Ocean or sometimes over a steel platform. Workers need to be tethered, as do all the tools. Furthermore, the inclusion of a dual seal design with a pressure test port will enable quick verification of the pressure integrity of the installation.

According to a first embodiment we provide a drilling system assembly comprising a blowout preventer (BOP) having a BOP housing which encloses a BOP passage, a first tubular element which encloses a flow passage and has a first end which provides a tubular pin end and a second end, a second tubular element which encloses a flow passage and has a tubular pin end, a first connector assembly, and a second connector assembly, the first connector assembly having a tubular connector body which encloses a central passage, the connector body having a first end in which is located the pin end of the first tubular element, and a second end which is provided a flange by means of which the connector assembly is bolted to the BOP housing to connect the flow passage of the first tubular element with the BOP passage via the central passage of the connector, the second connector assembly having a tubular connector body which encloses a central passage, the connector body having a first end in which is located the pin end of the second tubular element, and a second end which is secured to the second end of the first tubular element, to connect the flow passage of the first tubular element with the flow passage of the second tubular element via the central passage of the connector, wherein the first and second connector assemblies each further comprise a latching mechanism which comprises a plurality of locking segments which are movable between a lock position in which they engage with the pin end of the first or second tubular element respectively to prevent the pin end from being removed from the first end of the connector body, and an unlock position in which the pin end can be removed from the first end of the connector body, each locking segment being provided with a locking mechanism which is operable to releasably lock the locking segment in the lock position.

The first tubular element may comprise an RCD housing which encloses and supports a bearing assembly.

The first tubular element may comprise a sealing element which is configured to seal against an exterior surface of a tubular extending along the flow passage and which is supported by the bearing assembly. In this case, the first tubular element may further comprises a manifold spool, which includes at least one valve or choke. In this case, the sealing element may be between the BOP housing and the manifold spool.

The first tubular element may be a riser.

The second tubular element may be a riser.

The second connector assembly may be bolted to the second end of the first tubular element. The second connector assembly may be welded to the second end of the first tubular element.

According to a second embodiment we provide a connector assembly for use in connecting a tubular pin end to a housing or a further tubular, the connector assembly having a tubular connector body which encloses a central passage, the connector body having a first end which is adapted to receive the pin end, and a second end which is secured to the housing or further tubular, wherein the connector assembly further comprises a latching mechanism which comprises a plurality of locking segments which are independently movable between a lock position in which they engage with the pin end to prevent the pin end from being removed from the first end of the connector body, and an unlock position in which the pin end can be removed from the first end of the connector body, each locking segment being provided with a locking mechanism which is operable to releasably lock the locking segment in the lock position.

There may be a flange at the second end of the connector body by means of which the connector body can be bolted to a housing.

Advantageously, each locking mechanism is operable independently of the other locking mechanisms.

Each locking segment may engage with the connector body so that any force on the pin end acting to remove the pin end from the connector body when the locking segment is in the lock position is transferred to the connector body. Each locking segment may be located in a window provided in the connector body, and be movable generally perpendicular to the longitudinal axis of the central passage in the connector body such that when in the lock position it lies partially within the window and extends into the central passage of the connector body, and when moved to the unlock position is retracted so that the extent to which it extends into the central passage of the connector body is reduced. Advantageously, the cross-sectional area of the window does not decrease from the end of the window adjacent to the central passage of the connector body to the end of the window at the exterior of the connector body.

In one embodiment, the latching mechanism further comprises a plurality of actuator assemblies, one for each locking segment, each actuator assembly having a actuator which is releasably connected to one locking segment, and being mechanically operable independently of the others in a first direction to move its respective locking segment from its unlock position to its lock position, and in a second, opposite direction to move its respective locking segment from its lock position to its unlock position. The connection between the locking segment and the actuator may be configured such that the locking segment is confined to move with the actuator as the actuator moves in the first direction and the second direction, but is free to move relative to the actuator in a direction, which is perpendicular to the first and second direction. In this case, the locking mechanisms may be operable to engage with the actuator to prevent movement of the actuator in the second direction. The connection between the locking segment and the actuator may comprise a re-entrant channel, which is secured to one of the actuators and the locking segment, and a slider, which is located in the re-entrant channel and secured to the other one of the actuators and the locking segment.

In one embodiment, each actuator comprises a stud with a threaded shaft, and the locking mechanism comprises a clasp which is secured to the connector body, and which has a threaded aperture for receiving the threaded shaft of the stud, the locking mechanism further comprising a hasp arrangement which is operable to clamp the clasp around the shaft of the stud so as to prevent movement of the stud relative to the clasp.

According to a third embodiment we provide a set of connector assemblies comprising a first connector assembly according to the fourth embodiment of the invention and a second connector assembly according to the fourth embodiment of the invention wherein the dimensions and configuration of the first end of the connector body, and the dimensions and configuration of the latching mechanism are the same for the first connector assembly and the second connector assembly, whilst the diameter of the radially inwardly facing surface of the second end of the connector body is smaller for the first connector assembly than the second connector assembly. In this case, where the second end of the connector body of both the connector assemblies is provided with a flange by means of which the connector body may be bolted to a housing, and the axial thickness of the flange of the second connector assembly may be greater than the axial thickness of the flange of the first connector assembly.

A connector assembly having any feature or combination of features of the connector assembly according to the second embodiment may be used in the drilling system assembly according to the first embodiment.

BRIEF DESCRIPTION OF DRAWINGS

For a more complete understanding of the present invention, and the advantages thereof, reference is now made to the following descriptions taken in conjunction with the accompanying drawings, in which:

Fig. A is an isometric view of a typical drilling riser above the BOP on a jack-up drilling rig;

Fig. B is an isometric view of a typical drilling riser above the BOP on a jack-up drilling rig with an RCD housing installed;

Fig. C is an isometric view of a typical drilling riser above the BOP on a jack-up drilling rig with an RCD housing and an additional manifold spool installed;

Fig. D is an isometric view of a typical drilling riser above the BOP on a jack-up drilling rig with a spacer spool installed.

Figures 1, 2, 3, 4:
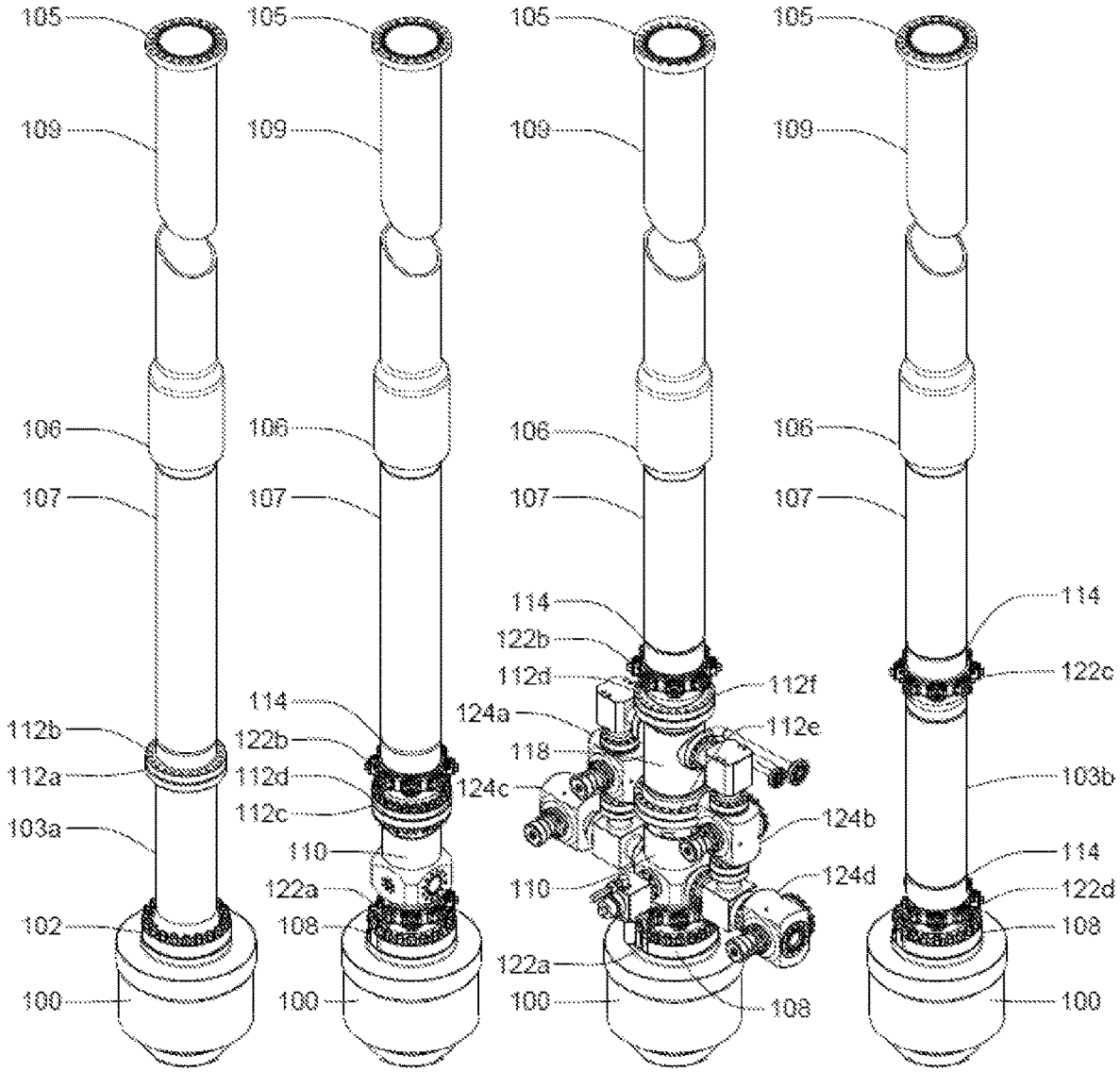
FIG. 1 (PRIOR ART) FIG. 2 FIG. 3 FIG. 4
Figure 6:
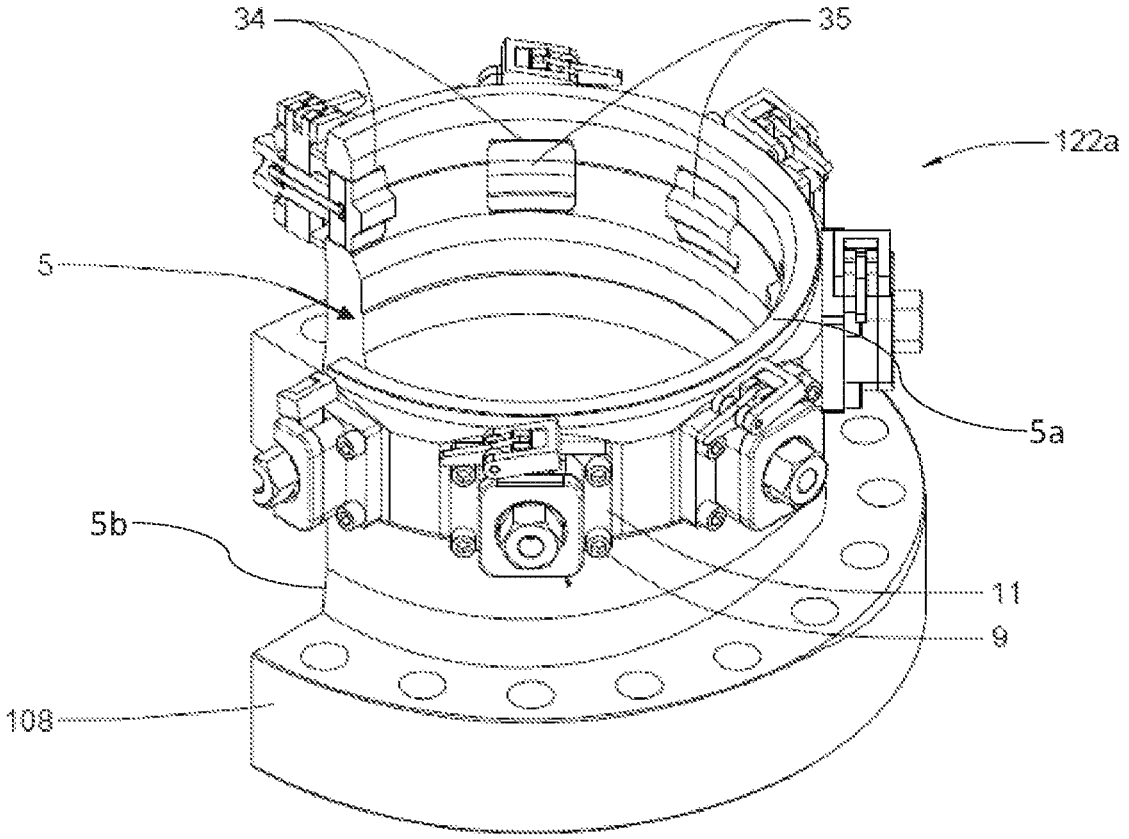
Figure 7:
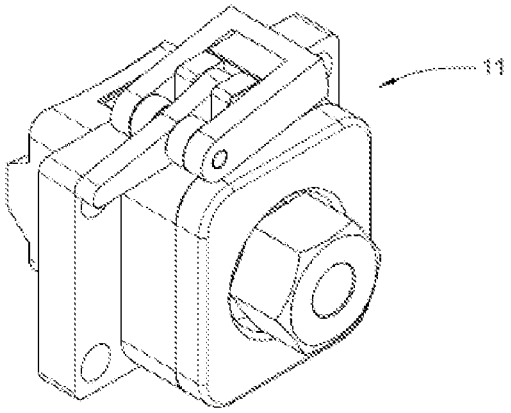
Figure 8:
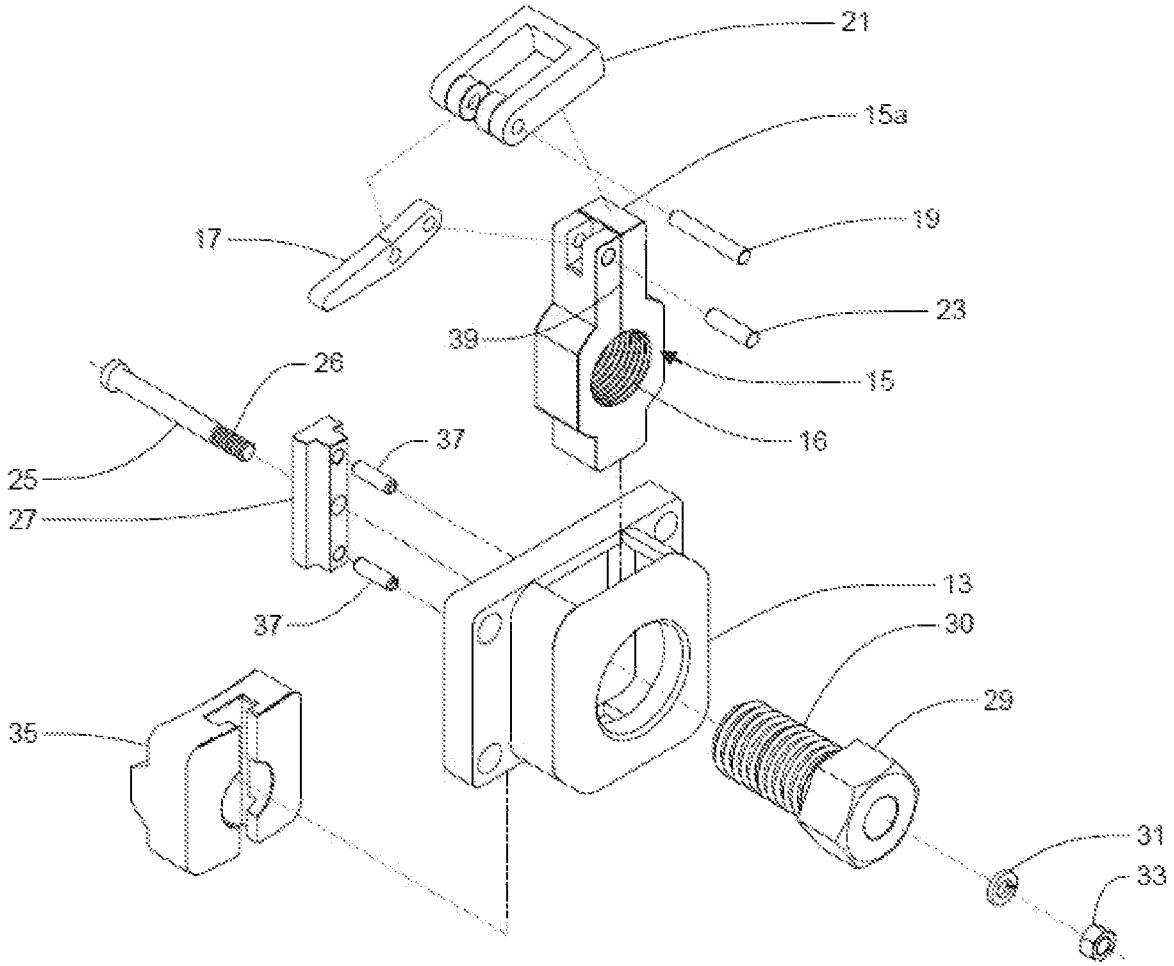

FIG. 1 is an isometric view of an assembled quick connector system;

FIG. 2 is a partial isometric view of the lower half of the quick connector system;

FIG. 3 is an isometric view of one assembled latch assembly for the quick connector system;

FIG. 4 is an exploded isometric view of a latch assembly for the quick connector system;

FIG. 5*a* is a cross section of the quick connector system before full engagement;

FIG. 5*b* shows a side view of the quick connector system before full engagement;

FIG. 6*a* is a cross section of the quick connector system fully engaged but not locked;

FIG. 6*b* shows a side view of the quick connector system fully engaged but not locked;

FIG. 7*a* is a cross section of the quick connector system fully engaged but not locked;

FIG. 7*b* shows the detail of the hasp mechanism for the quick connector;

FIG. 8*a* shows a side view of the quick connector system fully engaged and locked;

FIG. 8*b* shows the detail of the hasp mechanism when locked.

Figure 9A:
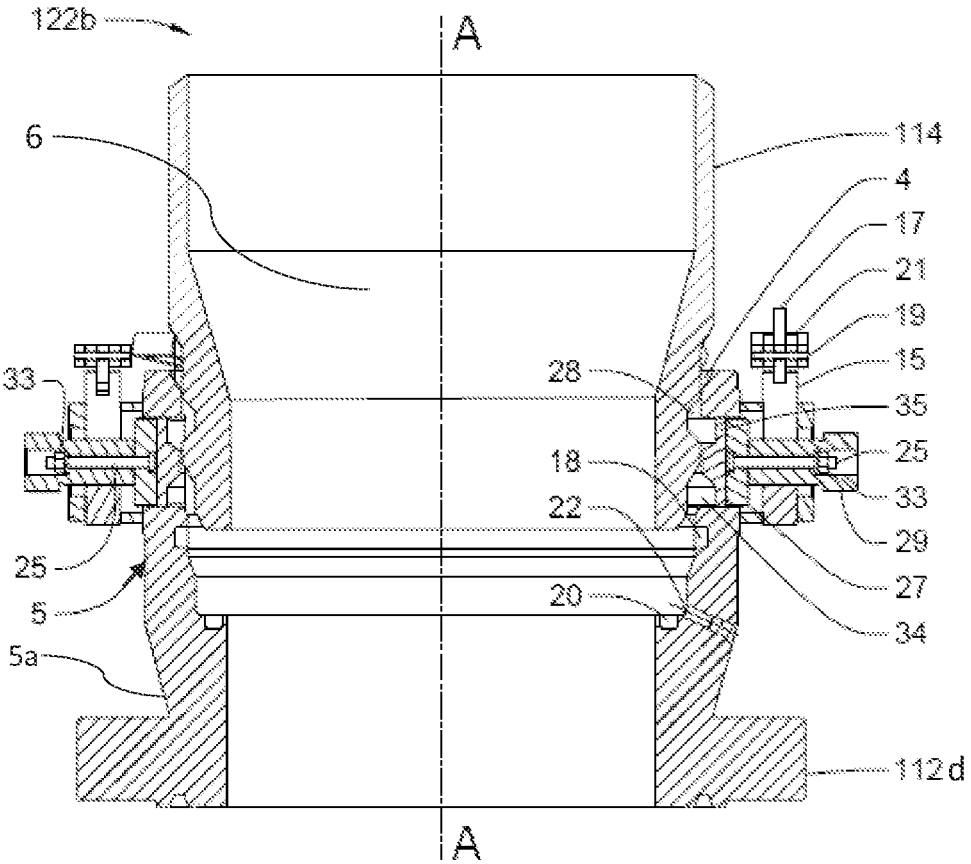
Figure 9B:
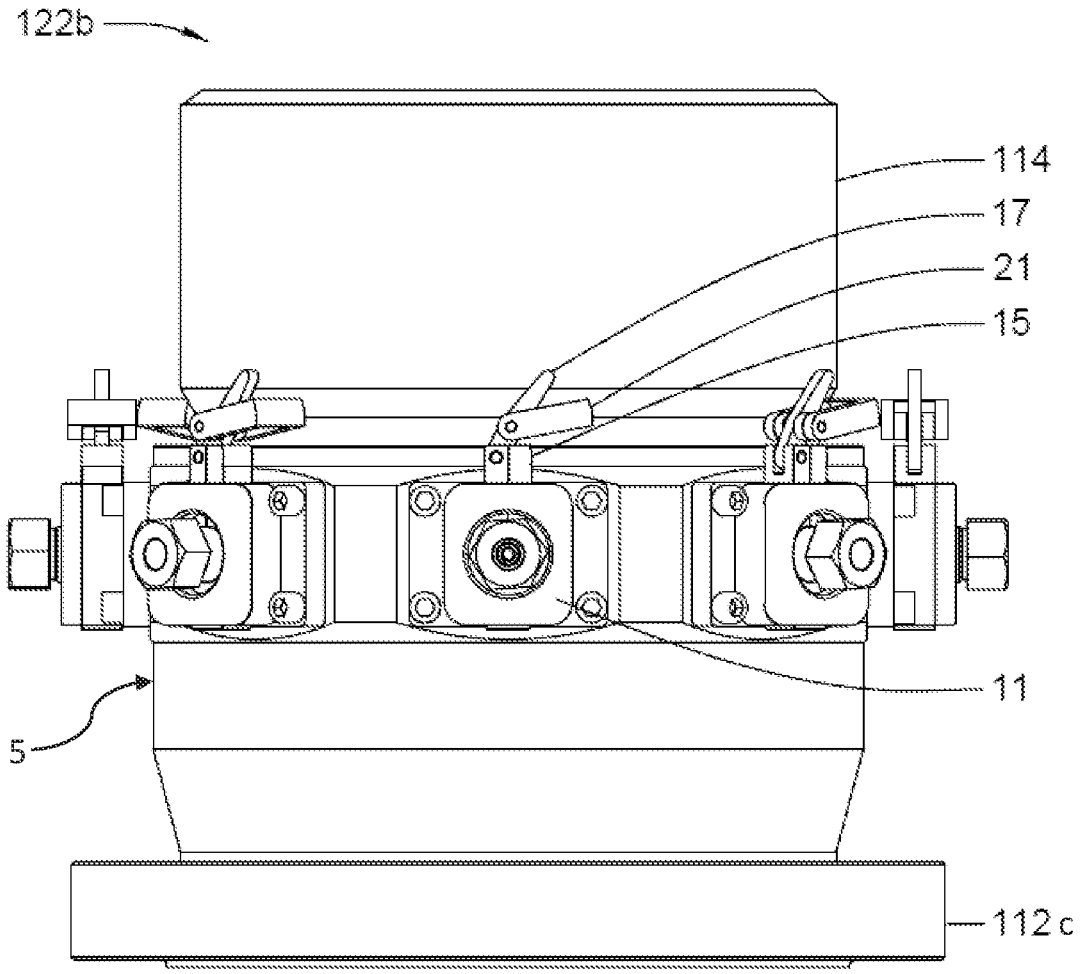
Figure 10A:
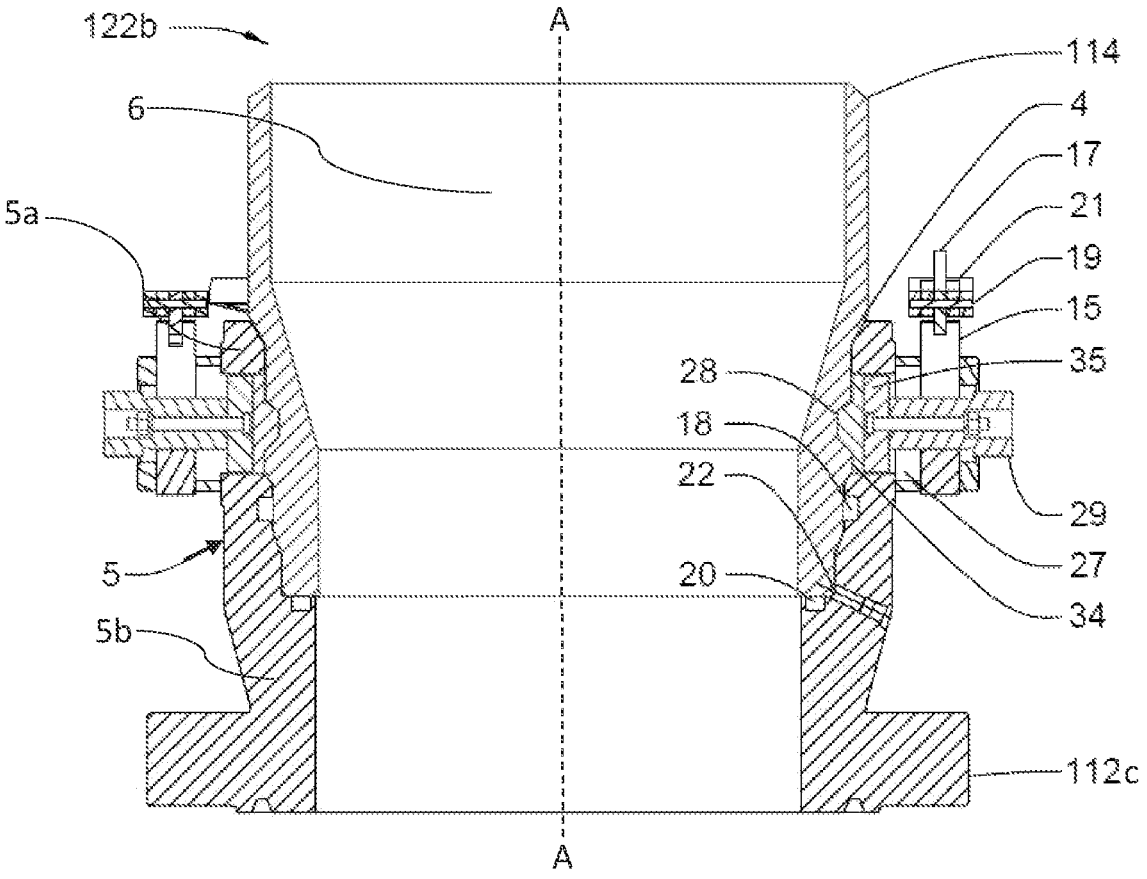
Figure 10B:
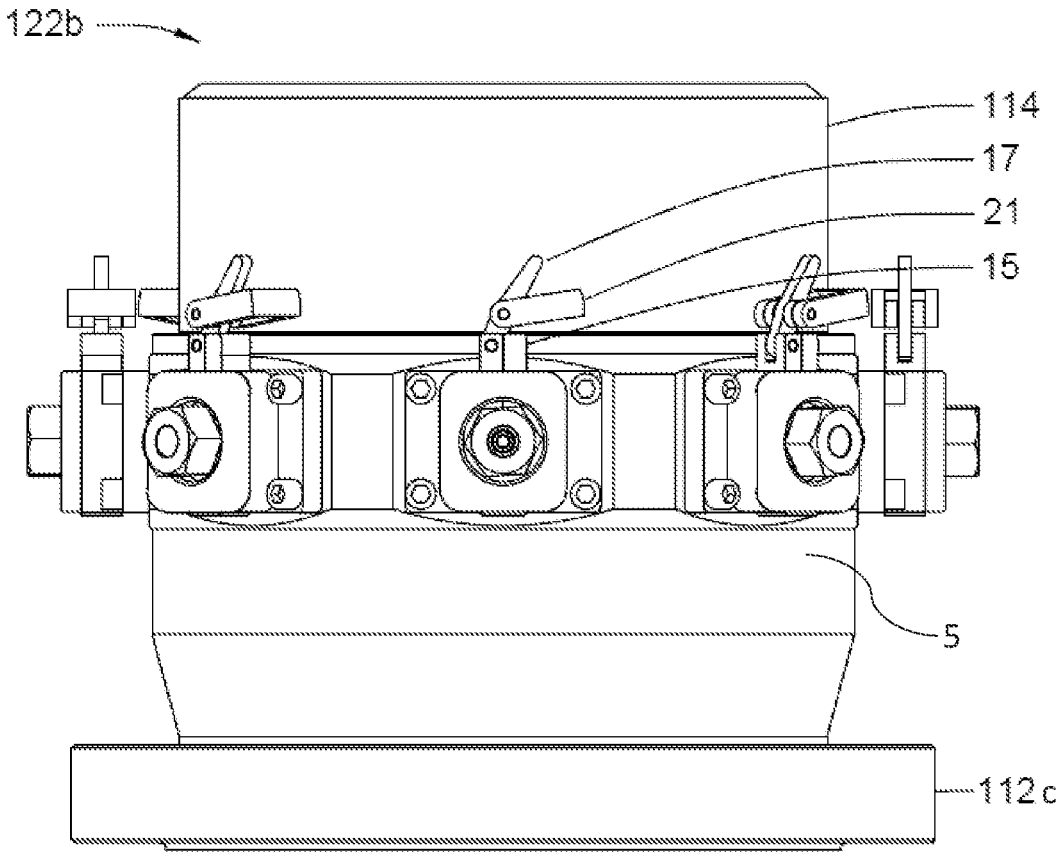
Figure 11A:
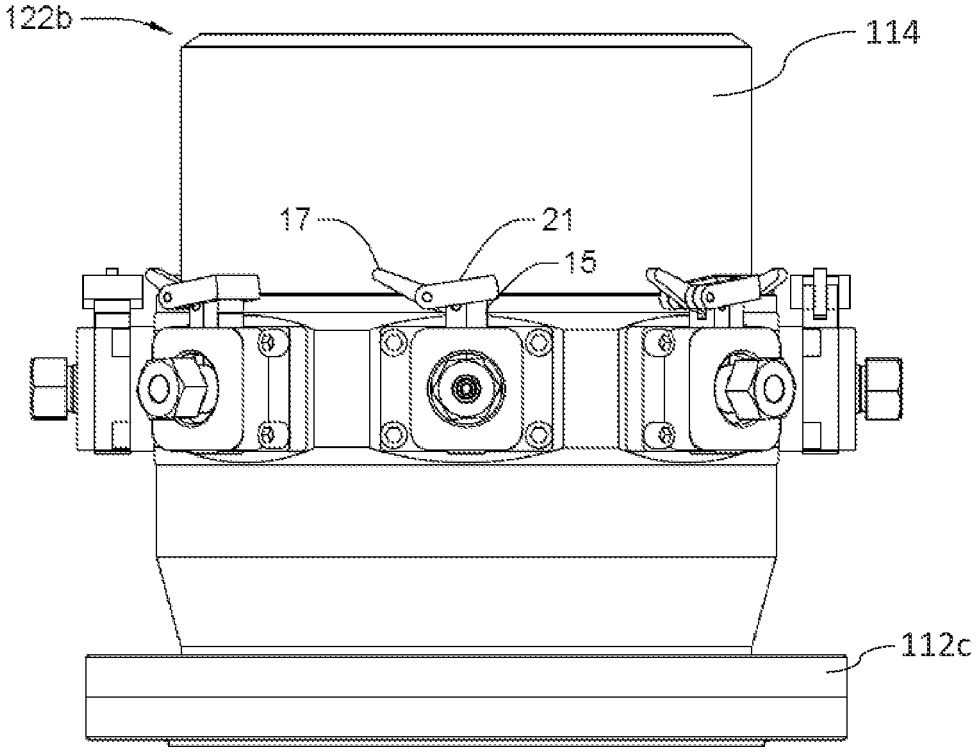
Figure 11B:
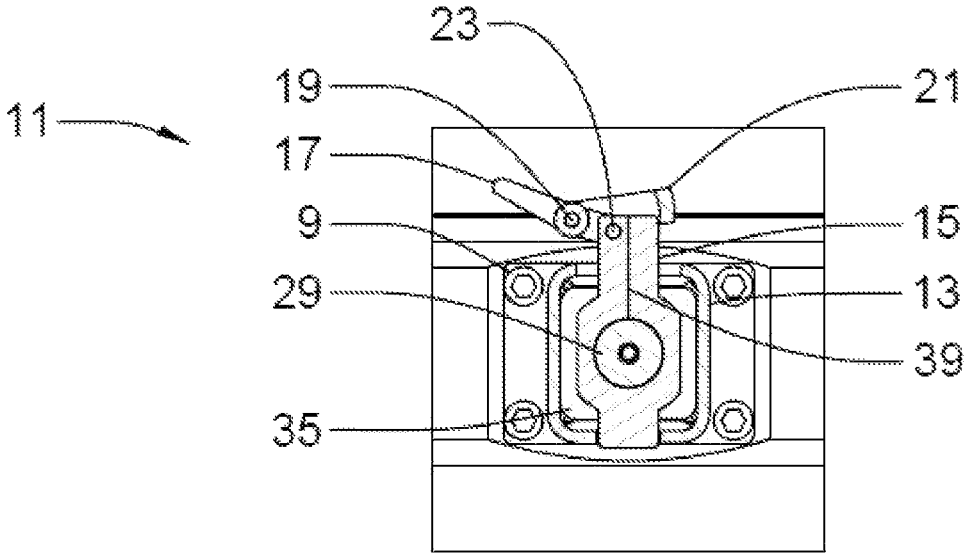
Figure 12A:
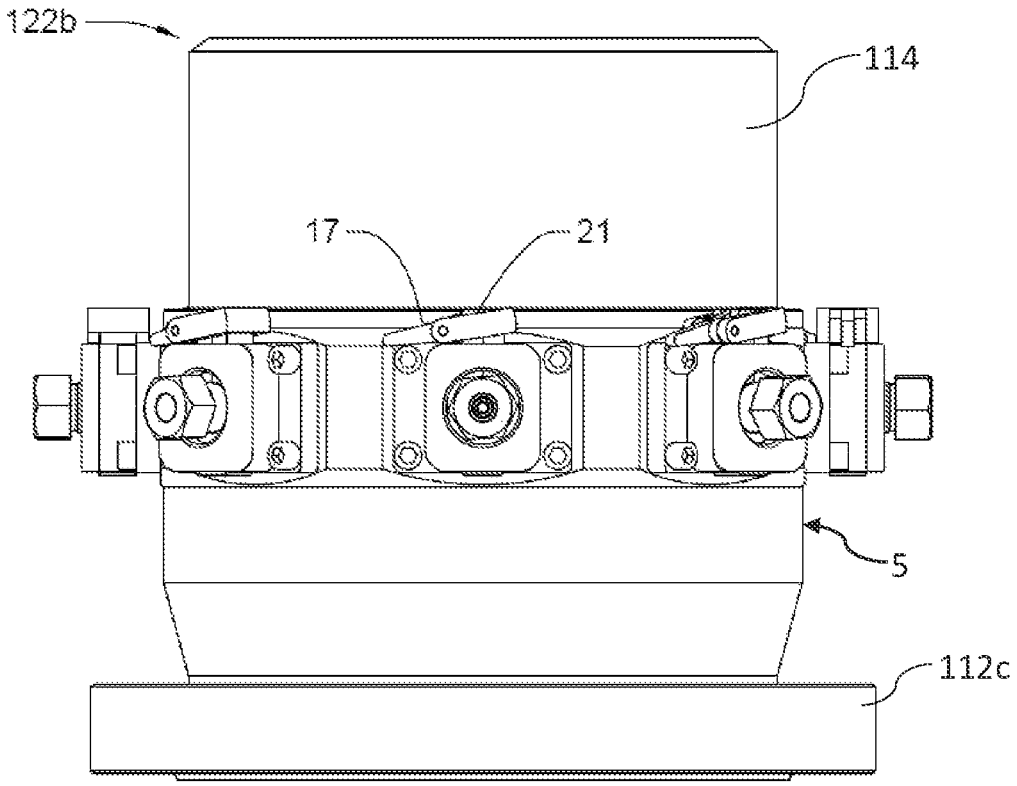
Figure 12B:
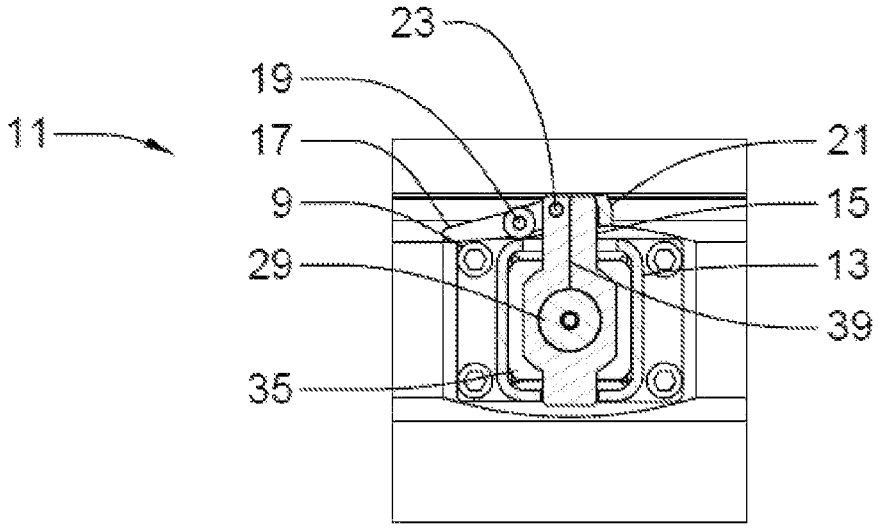
Figure 13A:
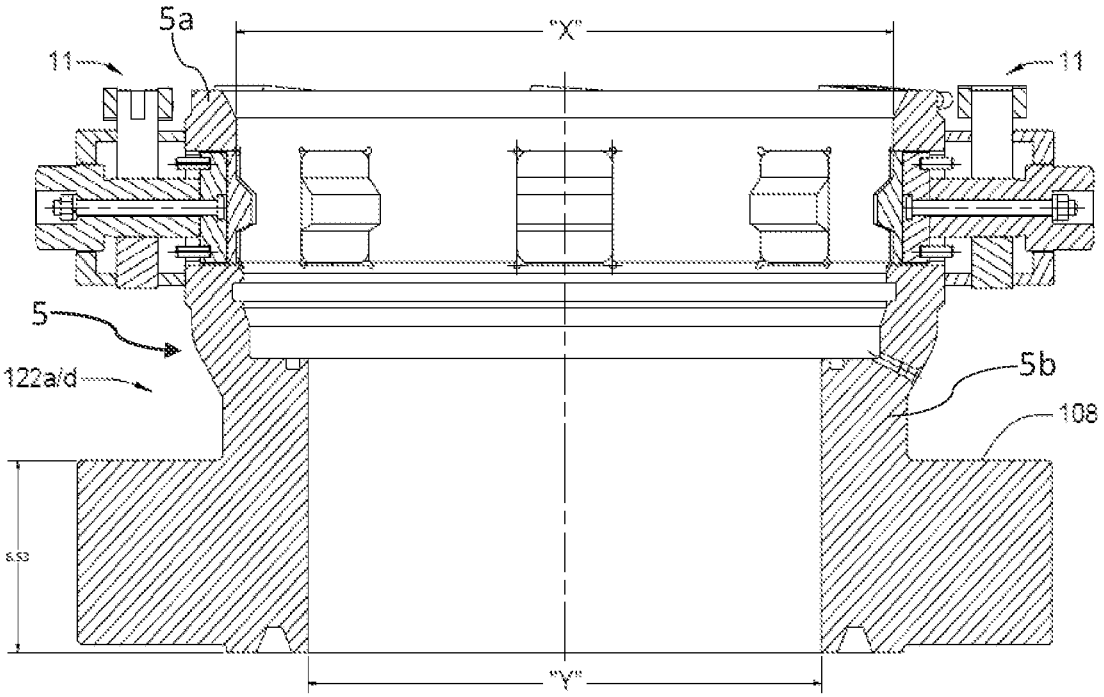
Figure 13B:
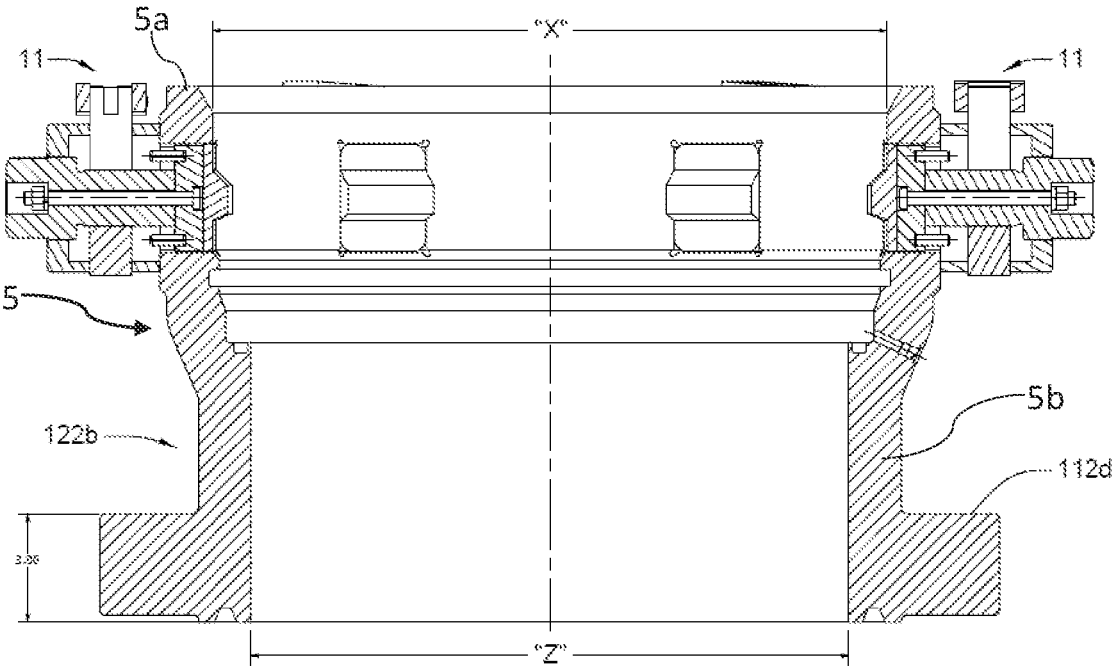

FIG. 9*a* shows an 18¾ inch bore by 5000 psi lower quick connector assembly;

FIG. 9*b* shows an 21¼ inch bore by 3000 psi lower quick connector assembly;

DETAILED DESCRIPTION OF THE INVENTIONS

The problems being solved and the solutions provided by the embodiments of the principles of the present inventions are best understood by referring to Figures A to D and 1 to 8 of the drawings, in which like numbers designate like parts.

Starting with Fig. A which depicts a typical prior art riser installation for an offshore jack-up drilling rig. On the bottom, we have an annular BOP 100, which is connected to the main BOP below (not shown). The annular BOP has a housing on top of which there are bolts, studded adapter, to receive a flange 102, which will typically be an 18¾ inch by 5000 or 10,000 psi API flange depending on the type of annular BOP. Then we have a riser spool 103*a* that is terminated at the bottom with flange 102, and terminated at the top by a 21¼ by 2000 psi API flange 112*a* or it can be 20¾ by 3000 psi API flange. Normally there will be a bore reducer welded at the bottom to accommodate the diameter change from 18¾ to the larger bore spool 103*a*, this is not shown. Then we have another mid riser spool 107 with a flange 112*b* on bottom and at the top a pin end that sit inside an overshot packer assembly 106 to accommodate some axial length differences that can occur on such rig-ups. The female end of the overshot packer assembly 106 is connected by some more riser tube 109 to a top flange 105 which bolts onto the bell nipple (not shown), an open piece of pipe just below the drilling rig floor with as side outlet that directs returning mud to the shale shakers. The exact details of this riser tube from annular BOP 100 to Bell nipple flange 105 can vary from rig to rig. In this particular example if one desired to install an RCD housing in the conventional manner, the spool 103*a* would have to be removed unbolting flanges 102 and 112*a*. Then an RCD body or housing 110 can be installed probably requiring another short custom-made spool, not shown, to replace the exact length of spool 103. This housing 110 is an outer housing of the RCD, and may enclose and support a bearing assembly. In use, the bearing assembly supports a sealing element (such as an RCD mandrel and stripping sleeve) which can seal around a tubular extending through the rotating control device, the bearing assembly being configured so that the sealing element can rotate with the tubular as it rotates about its longitudinal axis, some rigs do not have such a spool 103*a* and the mid riser spool 107 goes all the way to the annular BOP. This will require cutting of this longer spool 107 and fitting a new flange on the bottom to be able to install an RCD. This is all very time consuming as well as a hazardous operation involving scaffolding being built on top of the BOP stack (not shown) to access these parts for installation and de-installation with hammer wrenches and sledge hammers.

Figs. B to D are used to explain the purpose of the invention. Fig. B illustrates a riser installation including respectively lower and upper quick connector assemblies 122*a*, 122*b* according to the first aspect of the invention. The riser installation includes an RCD housing 110 that the bottom has a pin end that engages with the lower quick connector assembly 122*a*, the subject of this invention. The top of the RCD housing 110 has a flange 112*c*, usually the same type of flange as 112*a* from Fig. A. Then another quick connector assembly 122*b* is installed on top of the RCD housing 110. This quick connector assembly 122*b* consists of a flange 112*d* that is connected to the top flange 112*c* of the RCD housing 110, and connects the RCD housing 110 to a pin end 114 that is integral with the middle riser joint 107 The two quick connector assemblies 122*a* and 122*b* are identical in outer diameter and latching components, just the inner diameters are different, as well as concurrent variation in the diameters of the required seals. In this example, the flange 108 of the quick connector assembly 122*a* encloses a 18¾ inch bore, whilst the flange 112*d* of the quick connector assembly 122*b* encloses the same bore as flange 112*b* (typically 20¾ or 21¼ inches as explained in Fig. A).

Some customers prefer a complete manifold system as part of the RCD housing 110 and in Fig. C, we show the addition of a manifold spool 118 with additional valves 124*a*, 124*b*. This manifold spool 118 allows the return of drilling mud directly back into the riser above to use the usual drilling mud return path instead of exiting through valves 124*c* or 124*d* secured to the RCD housing 110. This manifold spool 118 has bottom and top flanges 112*e*, 112*f* the same as 112*c* and *d* from Fig. B. The bottom flange 112*e* is bolted to the top flange 112*c* of the RCD housing 110, whilst the top flange 112*f* is bolted to the flange 112*d* of the upper quick connector system 122*b*, which is identical to the one shown in Fig. B. As before the pin end 114 of the mid riser spool 107 engages with the upper quick riser connector system 112*b*, the mid riser spool 107 having been shortened by the length of the manifold spool 118

Referring to Fig. D, we have a lower riser spool 103*b* fitted with upper quick connect system 122*c* and lower quick connect system 122*d*. The upper quick connect system 122*c* is similar to the quick connect system 122*a*, but is not provided with a flange, as the connector body is welded directly to an end of the lower riser spool 103*b*. As such, the upper quick connect system 122*c* connects the pin end 114 of the mid riser spool 107 to the lower riser spool 103*b*. The lower quick connect system 122*d* is identical to the quick connect system 122*a* which connects the BOP housing 100 to an RCD housing 110 except that, rather than receiving a pin end which is an integral part of the RCD housing 110. Instead, it connects a pin end of the lower riser spool 103*b* to the BOP housing 100. The length of the lower riser spool 103*b* is the same as the total length of the spools 110 and 118 combined in Fig. C. This now allows for a drilling rig that has been fitted with this type of system including the quick connectors 122*a*, 122*b*, 122*c* and 122*d* to efficiently and safely switch between a conventional rig-up with no RCD as in Fig. D to a rig up with an RCD and a full manifold as in Fig. C without having to break or make up any riser API flanges. Similarly, it is possible for a customer that prefers the rig-up of Fig. B to have a correspondingly shorter spool 103*b* of same length as the RCD housing 110, to enable quick switching to the desired state of operations. For clarity, this would require a longer mid riser spool 107 to keep the standard distance between the top of the BOP 100 and the flange 105.

FIG. 1 is an isometric view of a typical complete lower quick connect assembly 122*a* of the sort illustrated in Figures B, C and D to connect the pin end at the bottom of the RCD housing 110 (as illustrated in Figures B & C). This is identical to the quick connect assembly 122*d* by means of which the pin end 114 of the lower riser 103*b* illustrated in Figure D is connected to the annular BOP, 100. It should be appreciated, however, that the upper quick connect assembly 122*b* which connects the RCD housing 110 or manifold spool 118 to a pin end 114 of a riser joint 107/103*b*, is of similar configuration, but with a larger internal bore suited for the riser sections The quick connect assembly 122*a* comprises a tubular connector body 5 which encloses a main passage 6 having a longitudinal axis A, and a latching mechanism consisting of several latch assemblies 11 arranged in an array around the circumference of a connector body 5, typically six to eight in number though they could vary from as low as four to more than eight. The number depends on the pressure capacity required of the connector. Each latch assembly 11 is an independent unit that is bolted with bolts 9 onto the connector body 5. The pin end 114 is lodged in a top end of the connector body 5, which on bottom has the flange 108, by means of which the quick connect assembly 122*a/d* may be connected to the studs at the top of the BOP 100, extends radially outwardly from a second end 5*b* of the connector body 5.

FIG. 2 shows the quick latching assembly of FIG. 1 with the upper pin 114 removed and it can be seen that the latch mechanisms 11 drive locking segments 35 through corresponding windows 34 cut in the connector body 5. The windows are configured so that the locking segments can be inserted into and removed from the windows from the exterior of the connector body 5. To achieve this, the cross-sectional area of each window at the exterior of the connector body 5 must be at least as large as the cross-section area of the window at the interior of the connector body 5 (with reference to a cross-section taken generally parallel to the axis A of the connector body 5). In this embodiment, to achieve this, the windows have a uniform cross-sectional area (with reference to a cross-section taken generally parallel to the axis A of the connector body 5).

FIG. 3 shows an isometric view of a complete latch assembly 11, which is common to both bore versions of the quick connector assembly's 122*a/d*, and 122*b/c*. In FIG. 4 we describe the individual parts that make up the latch assembly 11. We have the main load bearing part, which is the locking segment 35 that slides in the window 34 (not shown in FIG. 3 or 4). It transfers the load directly through the window to the connector body 5. Each locking segment 35 is releasably connected to an actuator of a mechanical actuator assembly which can be mechanically operated to move the locking segment generally perpendicular to the axis A of the connector body 5 between a lock position and an unlock position. When in the lock position, part of the locking segment 35 protrudes into the main passage 6 enclosed by the connector body 5, and when moved to the unlock position it is retracted so that the extent to which it extends into the main passage 6 of the connector body 5 is reduced.

In order not to have any forces on the other parts of the latch mechanism the locking segment 35 is mounted on a segment T-bar 27 on which it can freely float by an internal slot that slides on the segment T-bar 27, so that the locking segment 35 can move generally parallel to the longitudinal axis A of the connector body 5.

Figure 5:
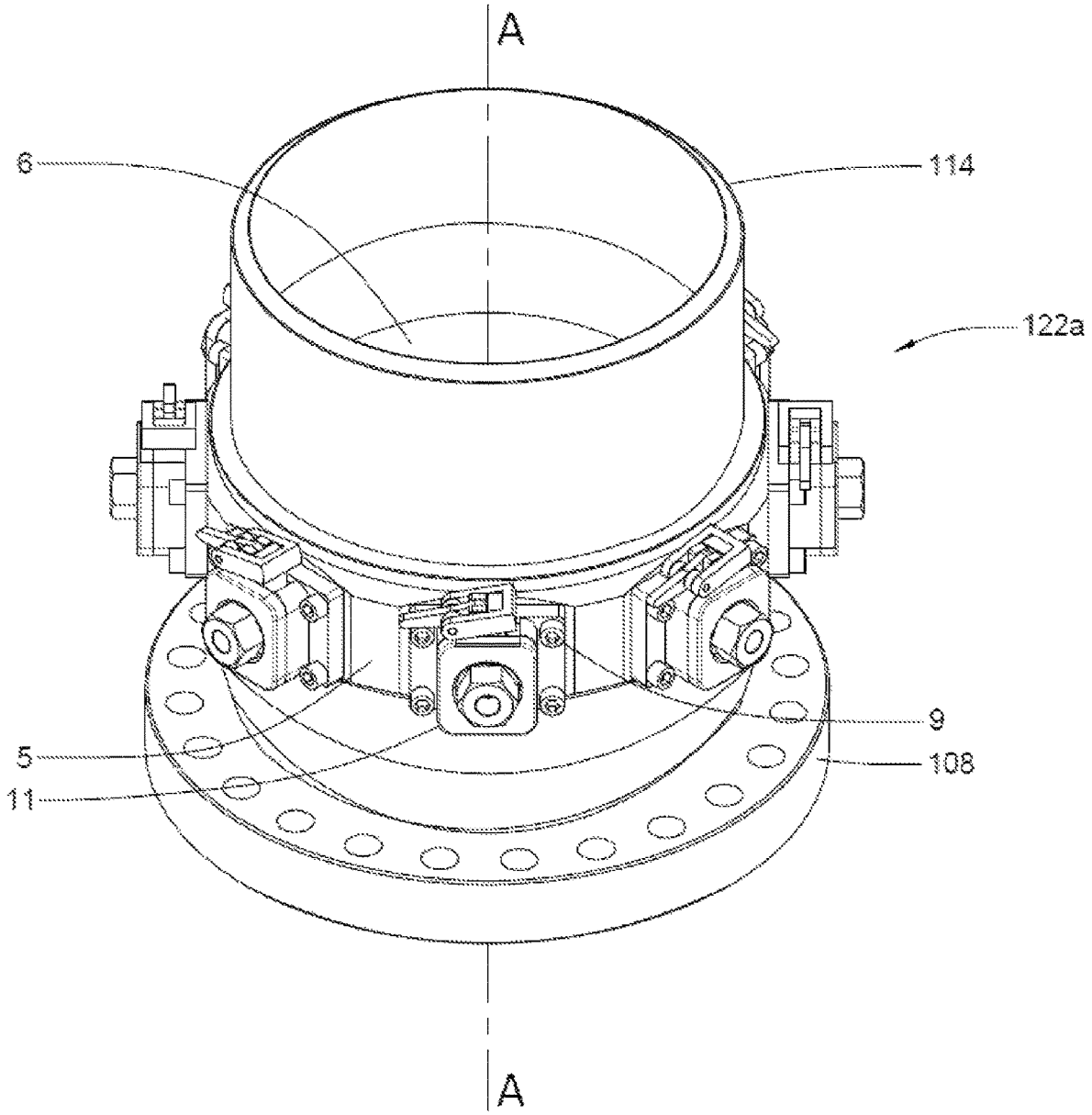

The latch assembly 11 has a body 13 which has a slot into which a clasp 15 can slide generally parallel to the longitudinal axis A of the connector body 5, the clasp 15 having an aperture with internal thread 16 that accepts the thread 30 of a threaded tension stud 29. The latching assembly 11 can be operated so that this stud 29 pushes on the T-bar 27 and the locking segment 35, so that the locking segment 35 moves radially inwardly to a lock position in which it engages in grooves (visible in FIG. 5) on the upper pin 114, and therefore creates the locking force for the quick latching assembly 122. In order to retract the locking segment 35, i.e. to move it radially outwardly relative to the connector body 5 as illustrated in FIG. 5, the T-bar 27 is bolted to the stud 29 with bolt 25 that threads with thread 26 into a locking washer 31 and nut 33. The stud 29 has a threaded shaft 30 with a longitudinal axis BB and a first end which engages with the T-bar 27, and a second end at which is provided a head, which in this embodiment is hexagonal. A central passage extends along the longitudinal axis B of the stud 29 through the shaft and head from the first end to the second end thereof. A threaded shaft of bolt 25 extends through an aperture in the T-bar 27 and along the aperture in the stud 29 so that a head of the bolt 25 engages with the T-bar 27, and the locking washer 31 and nut 33 are mounted on the free end of shaft of the bolt 25 to engage with the head of the stud 29. The T-bar 27 and stud 29 are therefore clamped between the head of the bolt 25 and the nut 33. This is best illustrated in FIG. 5.

The locking segments 35 are therefore movable in a direction which is generally perpendicular to the longitudinal axis A of the connector body 5 by rotating the stud 29 relative to the clasp 15 about its longitudinal axis BB in a first direction to move the locking segment 35 radially inwardly to the locking position, and in a second, opposite direction to retract the locking segment 35 as illustrated in FIG. 5. Once the stud 29 is fully engaged forcing the locking segment 35 into the grooves of pin 114, a locking mechanism is required to ensure that the stud pre-load is not lost during pressure load cycling of the riser. In addition, the riser can vibrate due to current loads from the ocean when in use, which, absent a lock mechanism, could cause the stud 29 to rotate relative to the clasp 15 and cause the locking segment 35 to move towards its retracted position. The lock mechanism uses a hasp assembly with a saw cut 39 through clasp 15 which extends from a catch end 15*a* of the clasp 15 generally perpendicular to the longitudinal axis BB of the stud 29 to the threaded aperture 16 in the clasp 15. The catch end 15*a* of the clasp 15 protrudes from the body 13, and is divided in two by the sawcut 39. The hasp assembly consists of hasp 21, lever 17 and pins 19, 23. The lever 17 is pivotally connected to one-half of the catch end 15*a* of the clasp 15 by pin 23, and the hasp 21 is pivotally connected to the central portion of the lever 17 by pin 19. The lever 17 can be lifted and the hasp 21 hooked over the catch end 15 of the clasp 15 so that it encircles both halves of the catch end 15*a*. The lever 17 can then be pushed down to tighten the hasp 21 around the catch end 15*a*, thus forcing the two halves of the catch end 15*a* together and tightening the saw cut 39 around the stud 29, thus locking the stud 29 in place. The clasp 15 can be released by lifting and pivoting the lever 17 so that the hasp 21 is lifted from around the catch end 15*a* of the clasp 15. The compressed sawcut 39 is thus released, so that the stud 39 can rotate relative to the clasp 15. This will be further explained with reference to the following figures.

Referring now to FIGS. 5A, 5B, 6A, these show the upper quick connector 122*b* which is used to connect the RCD housing 110 or manifold spool 118 to a pin end 114 of a riser joint 107/103*b*, is of the same configuration, where like parts have the same numbers. The pin end 114 is entering the first end of the connector body 5 of the upper quick connector assembly 122*b*. The locking segments 35 are fully withdrawn allowing the pin end 114 to be inserted into the first end of the connector body 5 until it lands on a shoulder 4 formed by the top edge of the first end of the connector body 5, as illustrated in FIG. 6A. There is an annular seal 18 and a face seal 20, which provide a fluid tight seal between the end of the pin end 114 and the connector body 5. A pressure verification port 22 extends through the connector body 5 from the exterior thereof to the space between the face seal 20 and the annular seal 18, and allows the seals to be tested after the connector is engaged. The lever 17 and hasp 21 are in the fully open position.

In FIGS. 6A and 6A, the connector pin 114 has landed on shoulder 4, and the tension stud 29 has been fully screwed in, pushing the locking segments 35 fully into the locking groove on the pin 114. At this stage, the required preload is applied to each tension stud 29 with the required stud torque.

The lever 17 is then rotated and the hasp 21 is engaged on the clasp 15, as illustrated in FIGS. 7A and 7B, and finally the lever 17 is pushed fully down so that the hasp 21 is fully locked down closing the saw cut 39 to tighten the threaded aperture 16 around the stud 29, thus locking the stud 29 as illustrated in FIGS. 8A and 8B The quick connector assembly is now ready for use. To uninstall the sequence is reversed. It can be appreciated that this sequence can be performed quickly as there is easy access to the stud heads 29 and the torqueing of these is simple compared to the differential torqueing method that must be employed for API flanges. Moreover, if there is a need to replace a locking segment 35, perhaps because the locking segment 35 has worn or broken, this can be done from the exterior of the connector body 5 without having to uncouple the connector body 5 from the pin end, by disassembling the latch mechanism, pulling the locking segment out through its window, uncoupling the locking segment 35 from the segment T-bar 27, coupling a new locking segment to the actuator, inserting the new locking segment through the window, and reassembling the latching mechanism.

In FIGS. 9*a* and 9*b*, we show schematic cross sections of the lower and upper quick connection systems 122*a/d*, 122*b*. As mentioned above, 122*a/d* and 122*b/c* are identical in outer diameter and latching components, just the inner diameters are different, as well as concurrent variation in the diameters of the required seals. In this example, the flange 108 of the quick connector assembly 122*a* encloses a 18¾ inches bore "Y" by API 5000 psi and, whilst the flange 112*d* of the quick connector assembly 122*b* encloses a 21¼ inches bore "Z" by API 3000 psi. As can be seen in these figures, the following items are common to the two designs: the outer dimensions, the locking profile dimensions "X", the locking mechanism assembly 11. The variation in bore diameter is achieved by varying the thickness of the second end 5*b* of the connector body 5. This is an advantageous design feature reducing complexity and manufacturing cost for the quick connection system, as many elements are common between the differing sizes and pressure requirements. Connector 122*c* is exactly the same as connector 122*b*, except instead of terminating in a flange 112*d* it terminates as a weld that connects it to riser tube 103*b*.

Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore contemplated that the claims will cover any such modifications or embodiments that fall within the scope of the invention.

What is claimed is:

1. A drilling system assembly comprising a blowout preventer (BOP) having a BOP housing which encloses a BOP passage, a first tubular element which encloses a flow passage and has a first end which provides a tubular pin end and a second end, a second tubular element which encloses a flow passage and has a tubular pin end, a first connector assembly, and a second connector assembly, the first connector assembly having a tubular connector body which encloses a central passage, the connector body having a first end in which is located the pin end of the first tubular element, and a second end which is provided a flange by means of which the connector assembly is bolted to the BOP housing to connect the flow passage of the first tubular element with the BOP passage via the central passage of the connector, the second connector assembly having a tubular connector body which encloses a central passage, the connector body having a first end in which is located the pin end of the second tubular element, and a second end which is secured to the second end of the first tubular element, to connect the flow passage of the first tubular element with the flow passage of the second tubular element via the central passage of the connector, wherein the first and second connector assemblies each further comprise a latching mechanism which comprises a plurality of locking segments which are movable between a lock position in which they engage with the pin end of the first or second tubular element respectively to prevent the pin end from being removed from the first end of the connector body, and an unlock position in which the pin end can be removed from the first end of the connector body, each locking segment being provided with a locking mechanism which is operable to releasably lock the locking segment in the lock position.

2. A drilling system assembly according to claim 1 wherein the first tubular element comprises an RCD housing.

3. A drilling assembly according to claim 2 wherein the first tubular element further comprises a manifold spool, which includes at least one, valve or choke.

4. A drilling assembly according to claim 3 wherein the sealing element is between the BOP housing and the manifold spool.

5. A drilling assembly according to claim 1 wherein the first tubular element is a riser.

6. A drilling assembly according to claim 1 wherein the second connector assembly is bolted to the second end of the first tubular element.

7. A drilling assembly according to claim 1 wherein the second connector assembly is welded to the second end of the first tubular element.

8. A connector assembly for use in connecting a tubular pin end to a housing or a further tubular, the connector assembly having a tubular connector body which encloses a central passage, the connector body having a first end which is adapted to receive the pin end, and a second end which is adapted to be secured to the further tubular, wherein the connector assembly further comprises a latching mechanism which comprises a plurality of locking segments which are independently movable between a lock position in which they engage with the pin end to prevent the pin end from being removed from the first end of the connector body, and an unlock position in which the pin end can be removed from the first end of the connector body, each locking segment being provided with a locking mechanism which is operable to releasably lock the locking segment in the lock position, the latching mechanism further comprising a plurality of actuator assemblies, one for each locking segment, each actuator assembly having an actuator which is releasably connected to one locking segment, and being mechanically operable independently of the others to move in a first direction to move its respective locking segment from its unlock position to its lock position, and in a second, opposite direction to move its respective locking segment from its lock position to its unlock position, the connection between the locking segment and the actuator being configured such that the locking segment is confined to move with the actuator as the actuator moves in the first direction and the second direction, but is free to move relative to the actuator in a direction which is perpendicular to the first and second direction, wherein the connection between the locking segment and the actuator comprises a re-entrant channel which is secured to one of the actuator and the locking segment, and a slider which is located in the re-entrant channel and secured to the other one of the actuator and the locking segment.

9. A connector assembly for use in connecting a tubular pin end to a housing or a further tubular, the connector assembly having a tubular connector body which encloses a central passage, the connector body having a first end which is adapted to receive the pin end, and a second end which is adapted to be secured to the further tubular, wherein the connector assembly further comprises a latching mechanism which comprises a plurality of locking segments which are independently movable between a lock position in which they engage with the pin end to prevent the pin end from being removed from the first end of the connector body, and an unlock position in which the pin end can be removed from the first end of the connector body, each locking segment being provided with a locking mechanism which is operable to releasable lock the locking segment in the lock position, the latching mechanism further comprising a plurality of actuator assemblies, one for each locking segment, each actuator assembly having an actuator which is releasably connected to one locking segment, and being mechanically operable independently of the others to move in a first direction to move its respective locking segment from its unlock position to its lock position, and in a second, opposite direction to move its respective locking segment from its lock position to its unlock position, wherein the locking mechanisms are operable to engage with the actuator to prevent movement of the actuator in the second direction, wherein each actuator comprises a stud with a threaded shaft, and the locking mechanism comprises a clasp which is secured to the connector body, and which has a threaded aperture for receiving the threaded shaft of the stud, the locking mechanism further comprising a hasp arrangement which is operable to clamp the clasp around the shaft of the stud so as to prevent movement of the stud relative to the clasp.

10. A set of connector assemblies comprising a first connector assembly and a second connector assembly, each connector assembly having a tubular connector body which encloses a central passage, the connector body having a first end which is adapted to receive the pin end, and a second end which is adapted to be secured to the further tubular, wherein the connector assembly further comprising a latching mechanism which comprises a plurality of locking segments which are independently movable between a lock position in which they engage with the pin end to prevent the pin end from being removed from the first end of the connector body, and an unlock position in which the pin end can be removed from the first end of the connector body, each locking segment being provided with a locking mechanism which is operable to releasably lock the locking segment in the lock position, wherein the dimensions and configuration of the first end of the connector body, and the dimensions and configuration of the latching mechanism are the same for the first connector assembly and the second connector assembly, whilst the diameter of the radially inwardly facing surface of the second end of the connector body is smaller for the first connector assembly than the second connector assembly.

11. A set of connector assemblies according to claim 10 wherein the second end of the connector body of both the connector assemblies is provided with a flange by means of which the connector body may be bolted to a housing, and the axial thickness of the flange of the second connector assembly is greater than the axial thickness of the flange of the first connector assembly.

* * * * *